US010654304B2

(12) United States Patent
Goto et al.

(10) Patent No.: US 10,654,304 B2
(45) Date of Patent: May 19, 2020

(54) METHOD FOR MANUFACTURING PANEL ELEMENT

(71) Applicant: SANWA SCREEN CO., LTD., Aisai-shi, Aichi (JP)

(72) Inventors: Yoshihide Goto, Aichi (JP); Kenshi Sakuma, Aichi (JP)

(73) Assignee: SANWA SCREEN CO., LTD., Aisai-shi (JP)

( * ) Notice: Subject to any disclaimer, the term of this patent is extended or adjusted under 35 U.S.C. 154(b) by 0 days.

(21) Appl. No.: 16/110,849

(22) Filed: Aug. 23, 2018

(65) Prior Publication Data

US 2019/0358985 A1 Nov. 28, 2019

(30) Foreign Application Priority Data

May 25, 2018 (JP) ..... 2018-100336

(51) Int. Cl.
*B41M 7/00* (2006.01)
*B41M 1/30* (2006.01)

(52) U.S. Cl.
CPC ..... *B41M 7/0081* (2013.01); *B41M 1/30* (2013.01); *B41P 2200/40* (2013.01)

(58) Field of Classification Search
CPC ..... B41M 7/0081; B41M 1/30; B41M 5/24; B41M 3/14; B41P 2200/40; B44C 1/228
See application file for complete search history.

(56) References Cited

U.S. PATENT DOCUMENTS 5,298,922 A * 3/1994 Merkle ..... B42D 25/324 283/85
7,172,912 B2 * 2/2007 Toyoda ..... B41M 5/24 257/E21.347
9,796,191 B2 * 10/2017 Wang ..... B41J 11/0015

FOREIGN PATENT DOCUMENTS

| | | | |
|---|---|---|---|
| JP | 59-66278 | U | 5/1984 |
| JP | S62-65076 | A | 3/1987 |
| JP | 04-066992 | A | 3/1992 |
| JP | 2005-017356 | A | 1/2005 |
| JP | 2014-044375 | | 3/2014 |

* cited by examiner

*Primary Examiner* — Michael P Wieczorek
(74) *Attorney, Agent, or Firm* — Rankin, Hill & Clark LLP

(57) ABSTRACT

A method for manufacturing the panel element (1) according to an aspect of the present invention includes: a process of printing a printed layer (4*a*) formed of an ink that does not transmit light on a front side of a resin sheet (3); a process of superimposing and printing a printed layer (4*b*) on an upper surface of the printed layer (4*a*) to form a laminated printed layer (4); and a process of irradiating the laminated printed layer (4) with laser light on a front side thereof to remove a part of the laminated printed layer (4) and to form a hole portion having a vertical end face in the laminated printed layer (4).

4 Claims, 3 Drawing Sheets

METHOD FOR MANUFACTURING PANEL ELEMENT

BACKGROUND

Technical Field

The present invention relates to a method for manufacturing a panel element used for an into decorative part for a vehicle or the like.

Related Art

Currently, for an interior decorative part for a vehicle or the like, a panel element having a surface to which a woodgrain tone or carbon tone design is applied and being illuminated with light from an internal light source is used. Screen printing, gravure printing, offset printing, and the like are well known as a method for printing such a design.

For example, an illumination cover element of JP 2014-44375 A described below is a bezel constituting a start button of an engine of an automobile, and a metal tone decorative portion having metallic gloss is disposed over the entire periphery on a front side of a panel element. In the metal tone decorative portion, three illumination portions including characters of "OFF", "ACC", and "ON" are displayed. That is, the illumination cover element is configured such that light can pass through a formation portion of each of the illumination portions, and is configured such that each of the illumination portions can emit light by illuminating the illumination portions from back sides thereof using a light source such as an LED.

In addition, the illumination cover element includes a supporting base material having a short cylindrical shape as a main body and a decorative film laminated and integrated on a front side of the supporting base material to form a metal tone decorative portion. The illumination cover element can be easily manufactured by film insert molding. Specifically, a film having protective layers on both surfaces of a thin metal layer is manufactured, and then a printed layer is printed on a back surface of the film to obtain a decorative film without unevenness.

The printed layer includes a light shielding printed layer formed of a non-light-transmissive black ink and a colored printed layer formed of a light-transmissive blue ink. The illumination portion is formed by removing the light shielding printed layer, a portion forming, light emitted from a back side passes only through the illumination portion. Meanwhile, the colored printed layer is formed of a light-transmissive blue ink, and makes the color of light passing through the illumination portion blue.

SUMMARY

In a case where it is desired to apply a design to the illumination cover element of JP 2014-44375 A, it is necessary to pile up multiple printed layers. In addition, in a case of piling up multiple printed layers, it is necessary to provide a larger missing portion for a lower printed layer considering a deviation of each layer. However, in such a structure, due to light passing through an upper printed layer, light leakage occurs in a peripheral portion of the illumination portion (character or graphic) to blur the illumination portion.

In addition, in JP 2014-44375 A, a light shielding printed layer is provided on a back surface of a back surface protective layer that is a printed base material. Therefore, when the back surface protective layer is irradiated with light from a back side thereof, the light is guided into the back surface protective layer and also passes through a contour of the illumination portion provided on the thin film metal layer to blur the illumination portion. Meanwhile, if the light shielding printed layer is provided on a surface of the back surface protective layer, a problem that the illumination portion is doubly projected because the shadow of light from the light shielding printed layer on the back side is picked up occur.

The present invention has been achieved in view of these circumstances, and an object of the present invention is to provide a method for manufacturing a panel element capable of preventing light leakage to obtain a clear character or graphic.

The present invention is a method for manufacturing panels including a transparent sheet of which front side printed. The method consists of process of printing a first printed layer formed of an ink that does not transmit light on the front side of the transparent sheet and process of forming a laminated printed layer by printing a second printed layer on an upper surface of the first printed layer and process of forming a hole portion that have vertical end face in the laminated printed layer by removing a part of the laminated printed layer with laser light.

The panel element made by the present invention is an element including a transparent sheet having a front side printed, and is, for example, an element illuminated with light of a light source arranged on a back side of the transparent sheet. It is used as a car interior decorative part etc. The front side of the transparent sheet is decorative because this panel element made by a process of printing a first printed layer on a front side of a transparent sheet, and a process of forming a laminated printed layer by printing a second printed layer on an upper surface of the first printed layer.

After forming the laminated printed layer, a process of irradiating the laminated printed layer with laser light on a front side thereof is performed. As a result, a part of the laminated printed layer is removed, and a hole portion having a vertical end face (including a substantially vertical end face) is formed in the laminated printed layer. In the panel element, light is emitted through the hole portion thereof to a front side thereof, and a character or a graphic is displayed on a surface thereof. Because incomplete light shielding area is not exist due to the vertical end face of a hole portion, a clear character or graphic can be displayed.

In the method for manufacturing the panel element according to an aspect of the present invention, an ink that absorbs the laser light is preferably used for the first printed layer.

In this structure, by the ink of the first printed layer absorbing laser light and reacting, the first printed layer and the second printed layer on it can be removed together. Then, by scanning the laminated printed layer with laser light to remove the laminated printed layer, a hole portion in the shape of a target character or graphic can be obtained.

In addition, in the method for manufacturing the panel element according to an aspect of the present invention, the second printed layer preferably includes multiple printed layers.

In this structure, by superimposing multiple printed layers, it is possible to apply a decoration requiring multiple colors, such as a woodgrain tone or a carbon tone, to a front side of a transparent sheet.

In addition, the method for manufacturing the panel element according to an aspect of the present invention preferably further includes a process of printing a third printed layer on a back side of the transparent sheet before the process of forming the hole portion, and in the process of forming the hole portion, the hole portion is preferably formed at a position corresponding to the third printed layer.

In this structure, after performing the process of printing the third printed layer on the back side of the transparent sheet, a hole portion is formed at a position corresponding to the third printed layer in the process of forming the hole portion in the laminated printed layer. This makes it possible to visually recognize the third printed layer through the hole portion in the shape of the target character or graphic. Decorativeness of the panel element can be improved by being manufactured with this manufacturing method.

In addition, in the method for manufacturing the panel element according to an aspect of the present invention, an ink that does not absorb the laser light is preferably used for the third printed layer.

In this structure, the third printed layer is not deteriorated or destroyed in the process of forming the hole portion in the laminated printed layer because the ink used for the third printed layer does not absorb laser light.

In addition, in the method for manufacturing the panel element according to an aspect of the present invention, the third printed layer preferably includes a colored layer colored in a predetermined color and a white layer that prevents light to be emitted to the front side of the panel element directly by letting light passing through only the transparent sheet.

In this structure, by printing the colored layer, it is possible to apply a decoration in which a predetermined color can be visually recognized through the hole portion of the panel element. In addition, by printing the white layer, it is possible to prevent light from being directly emitted to the front side of the panel element.

In addition, in the method for manufacturing a panel element according to an aspect of the present invention, the transparent sheet preferably has a thickness of 0.5 mm or less.

The third printed layer appears to be depressed depending on the thickness of the transparent sheet because the third printed layer is formed on a back side of the transparent sheet. In this structure according to an aspect of the present invention, by setting the thickness of the transparent sheet to 0.5 mm or less, the third printed layer can be appeared to be flat to some extent.

DETAILED DESCRIPTION

Hereinafter, an embodiment of a panel element according to an aspect of the present invention is described.

Figure 1:
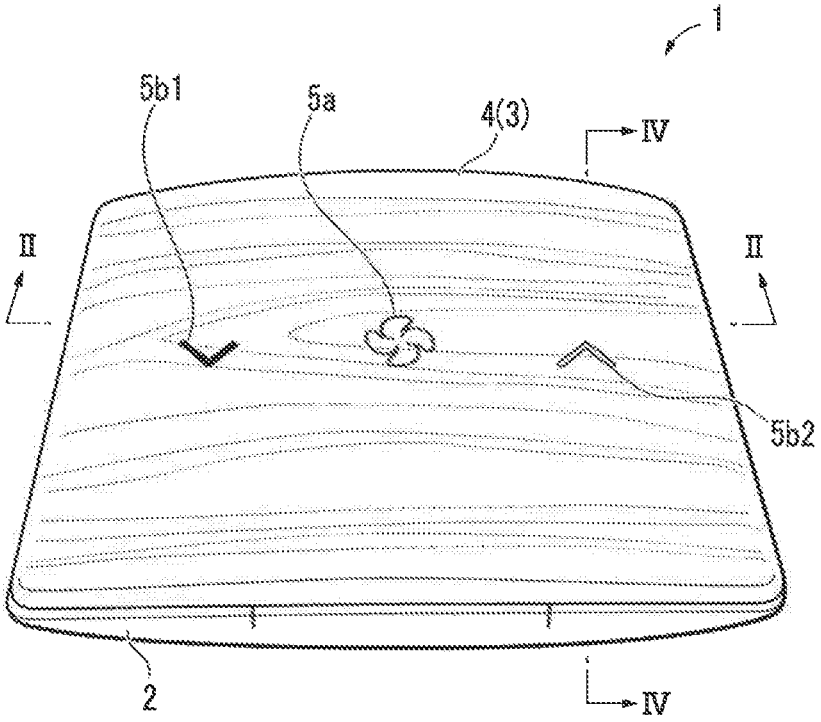
FIG. 1 is a front view of a panel element.

FIG. 1 is an overall structure of a panel element according to an aspect of the present invention. A panel element 1 is manufactured by so-called film insert molding, in which a decoration is printed on at least a front side of a resin sheet 3, and then pressure is applied to the resin sheet 3 to integrate the resin sheet 3 with a molded resin portion 2. The panel element 1 is used, for example, as an interior decorative part for a vehicle.

The molded resin portion 2 is a plastic plate element having a thickness of about 3 mm, and a shallow recess matching the shape of the resin sheet 3 after a forming process is formed on a surface of the molded resin portion 2. In addition, a back surface of the molded resin portion 2 has a side plate having a height of about 15 mm so as to house a light source (LED substrate) which will be described below. The molded resin portion 2 is preferably a transparent or translucent material through which light from a light source passes.

The resin sheet 3 is a light-transmissive film such as polycarbonate (PC), a polyethylene terephthalate resin (PET), a polymethyl methacrylate resin (PMMA), an acrylic, a multilayer sheet of polycarbonate and acrylic, or polypropylene. Although details are described below, the thickness of the resin sheet 3 is preferably 0.5 mm or less.

A laminated printed layer 4 printed by high definition screen printing is formed on a front side of the resin sheet 3. The laminated printed layer 4 includes multiple printed layers. FIG. 1 illustrates that a woodgrain tone decoration is drawn on a surface of the panel element 1. The laminated printed layer 4 is formed by superimposing two to five printed layers such as brown printed layers and woodgrain fine lines printed layers. Note that the decoration is not limited to a woodgrain tone, but can be various decoration such as a carbon tone, piano black (gloss black), or the like.

In addition, the panel element 1 has graphics 5*a*, 5*b*1, and 5*b*2 which are consisting of punched characters or punched patterns on a surface thereof. Although details are described below, after completion of the laminated printed layer 4, it is removed in a shape of a desired graphic by being scaned with laser light of the laser marking device (for example, light of Nd: YAG laser having a wavelength of 1,064 μm). As a result, hole portions of the graphics 5*a*, 5*b*1, and 5*b*2 are formed in the laminated printed layer 4.

In the graphic 5*a*, only at an outline of a four-leaf mark a hole portion is formed, and light of a light source arranged on a back side of the molded resin portion 2 passes therethrough. In addition, a printed layer is printed on a back side of the resin sheet 3 such that the graphics 5*b*1 and 5*b*2 have different patterns or colors from each other.

In the graphic 5*a* through which light passes, no printed layer is provided on the back side of the resin sheet 3. However, when it is not desired to directly irradiate a front side of the panel element 1 with light, a white printed layer may be provided on the back side of the resin sheet 3.

Figure 2:
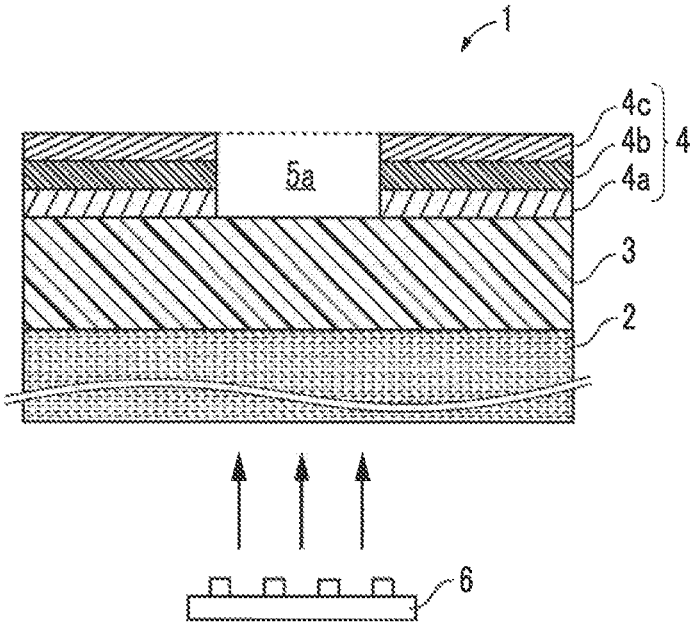
FIG. 2 is a cross-sectional view of the panel element taken along line

Next, FIG. 2 illustrates a cross-sectional view of the panel element 1 of FIG. 1 taken along line II-II.

In the panel element 1, the resin sheet 3 which has been subjected to a forming process by pneumatic forming or the like is attached to a front side of the molded resin portion 2. The laminated printed layer 4 on a front side of the resin sheet 3 includes a printed layer 4*a* (the "first printed layer" according to an aspect of the present invention) through which light from a light source 6 does not pass, and printed layers 4*b* and 4*c* (the "second printed layer" according to an aspect of the present invention) mainly constructing a decoration. In a case where the decoration has a single color (in particular, black type), it can be constructed with only the printed layer 4*a*, but usually at least two or more printed layers are superimposed to construct a decoration.

In FIG. 2, a portion where the laminated printed layer 4 is removed is the graphic 5*a* (outline of the four-leaf mark)

in FIG. 1. In spite of the light source 6 is arranged on the back side of the molded resin portion 2, light of the light source 6 is emitted from the portion of the graphic 5*a* to the front side of the molded resin portion 2 because the molded resin portion 2 and the resin sheet 3 are light-transmissive materials.

Next, with reference to FIGS. 3A to 3C, a method for manufacturing a cross-sectional portion of the panel element 1 of FIG. 1 taken along line II-II will be described. Note that the cross section of the molded resin portion 2 is omitted in the following description.

Figure 3A:
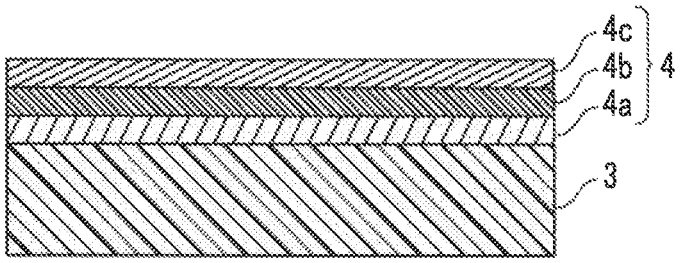
FIG. 3A to FIG. 3C are views for explaining a method for manufacturing the panel element (a cross-sectional portion taken along line II-II)

As illustrated in FIG. 3A, the laminated printed layer 4 is formed with screen printing on the front side of the resin sheet 3 from a lower layer in order of the printed layers 4*a*, 4*b*, and 4*c*. The printed layer 4*a* is a layer of a black pigment containing an ink that easily absorbs laser light (Nd: YAG laser, $CO_2$ laser, or the like) of a laser marking device, for example, carbon black. In addition, by making the printed layer 4*a* a black layer, a light shielding effect can also be obtained.

The printed layers 4*b* and 4*c* are layers constructing a decoration of the panel element 1. For example of woodgrain tone decoration, the printed layer 4*b* is a brown woodgrain layer, and the printed layer 4*c* is a layer with woodgrain fine lines. In a case of forming a woodgrain tone decoration, actually, it is necessary to superimpose five or more printed layers. However, here a simplified three-layer structure is used for the sake of explanation.

Figure 3B:
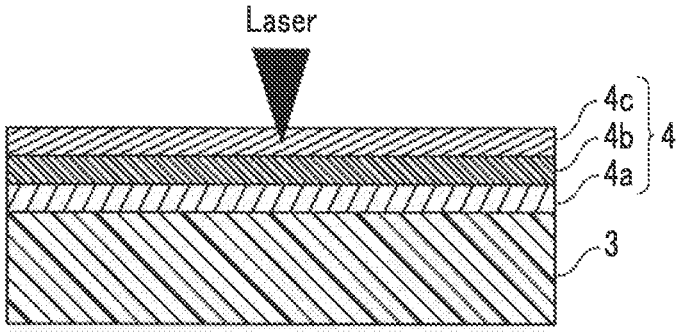

Next, as illustrated in FIG. 3B, in order to draw the graphic 5*a*, the laminated printed layer 4 is irradiated with laser light from the front side thereof. As a result, the printed layers 4*b* and 4*c* which are upper layers are melted by heat of the laser light. In addition, when the laser light reaches the printed layer 4*a*, the laser light is absorbed, and the printed layer 4*a* is removed (ablated) by a chemical reaction.

Figure 3C:
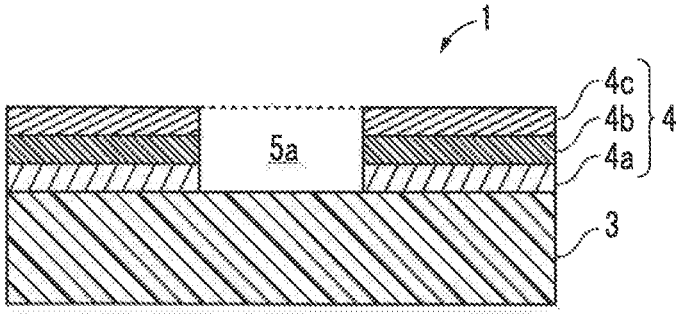

Thereafter, as illustrated in FIG. 3C, the printed layers 4*b* and 4*c* are destroyed in accordance with removal of the printed layer 4*a*. Then, the laminated printed layer 4 is scanned with laser light to remove a part of the laminated printed layer 4 in the shape of the graphic 5*a*. At this time, by narrowing the diameter of the laser light, an extremely small hole portion can be formed. Therefore, an end face of the hole portion can be vertical.

If the end face of the hole portion is not vertical and the hole portion of the printed layer 4*c* is smaller than the hole of each of the printed layers 4*a* and 4*b*, a portion through which the light of the light source 6 passes is narrow. In addition, a portion protruding toward the center of the hole from the end face of the hole of each of the printed layers 4*a* and 4*b* in the printed layer 4*c* (having a thickness of 3 to 6 μm) can not shield the light completely. The incomplete light shielding area blur graphics. However, in the manufacturing method according to an aspect of the present invention, end faces of the holes of the printed layers 4*a*, 4*b*, and 4*c* are aligned vertically. Therefore, incomplete light shielding area does not exist in a peripheral portion of the graphic 5*a*, and a contour of the graphic 5*a* becomes clear.

Next, with reference to FIGS. 4A to 4C, a method for manufacturing a cross-sectional portion of the panel element 1 of FIG. 1 taken along line IV-IV will be described. Also hereinafter, the cross section of the molded resin portion 2 is omitted.

Figure 4A:
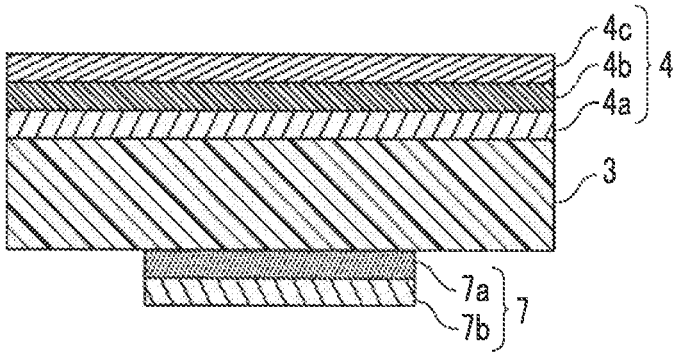
FIG. 4A to FIG. 4C are views for explaining a method for manufacturing the panel element (a cross-sectional portion taken along line IV-IV).

As illustrated in FIG. 4A, the laminated printed layer 4 is formed with screen printing on the front side of the resin sheet 3 from a lower layer in order of the printed layers 4*a*, 4*b*, and 4*c*. Also here, the printed layer 4*a* is a layer of ink that easily absorbs laser light, and the printed layers 4*b* and 4*c* are layers constructing a decoration of the panel element 1.

In addition, a back surface printed layer 7 is formed with screen printing on the back side of the resin sheet 3 from a lower layer (layer in contact with the resin sheet 3) side in order of printed layers 7*a* and 7*b* (the "third printed layer" according to an aspect of the present invention). This is because if a printed layer for graphics is superimposed and printed on the front side of the resin sheet 3 (upper surface of the printed layer 4*c*), only this portion becomes convex to deteriorate an appearance.

For example, in the back surface printed layer 7, the printed layer 7*a* is a red layer (an example of the "colored layer" according to an aspect of the present invention), and the printed layer 7*b* is a white layer (the "white layer" according to an aspect of the present invention). In this way, by superimposing three to four printed layers, it is possible to draw a pattern, a mark, or the like. Note that the back surface printed layer 7 may include only the printed layer 7*a* having a predetermined color.

Here, the printed layers 7*a* and 7*b* are layers that do not absorb laser light of the laser marking device, that is, layers of an ink not deteriorated or destroyed by the laser light. As the ink of the white layer, for example, a pigment containing titanium oxide is used.

Figure 4B:
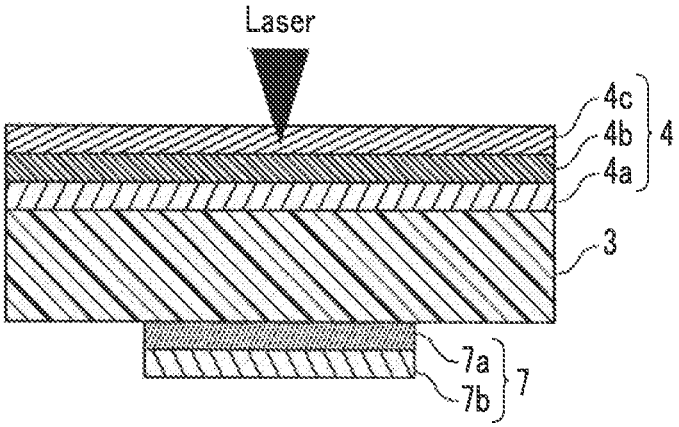

Next, as illustrated in FIG. 4B, in order to draw the graphic 5*b*2, the laminated printed layer 4 is irradiated with laser light on a front side thereof. As a result, at the time of removal (ablation) of the printed layer 4*a*, the printed layers 4*b* and 4*c* are both destroyed.

Figure 4C:
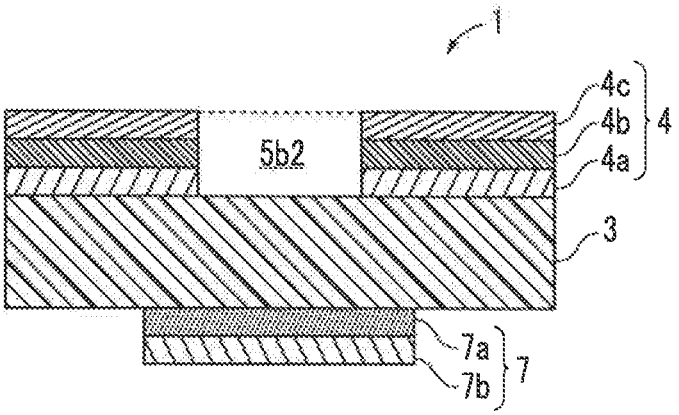

Thereafter, the laminated printed layer 4 is removed in the shape of the graphic 5*b*2 by being scanned with laser light as illustrated in FIG. 4C. In addition, at this time, an end face of a hole portion becomes vertical. Because incomplete light shielding area does not exist in a peripheral portion of the graphic 5*b*2 a contour of the graphic 5*b*2 is clear.

In this process, the laser light passes through the resin sheet 3 and reaches the back surface printed layer 7. However, the printed layers 7*a* and 7*b* are not deteriorated by the laser light, and therefore the printed layers 7*a* and 7*b* remain as they are. As a result, the graphic 5*b*2 is a color or a pattern constructed by the printed layers 7*a* and 7*b* as seen from a top surface of the panel element 1. Note that the printed layers 7*a* and 7*b* are printed so as to be wider than the shape of the graphic 5*b*2 in consideration of a slight deviation of the position of a hole.

The resin sheet 3 preferably has a thickness of 0.5 mm or less. At least the laminated printed layer 4 is much thinner (about 50 μm even in a case of 10 layers) than the resin sheet 3. Therefore, the printed layers 7*a* and 7*b* are disposed on the back side of the resin sheet 3, but actually the back surface printed layer 7 does not appear to be so deep. That is, the back surface printed layer 7 can appear to be flat to some extent, and an aesthetic appearance can be maintained. In addition, by reducing the thickness of the resin sheet 3, it is able to obtain an effect of suppressing an influence on an adjacent graphic due to light guiding inside the sheet.

Laser marking may be performed after the forming process of the printed resin sheet 3 or after attachment of the resin sheet 3 to the molded resin portion 2, that is, after injection. According to the latter method, distortion of a graphic is hardly generated, and the graphic can be deployed at a predetermined position of the panel element 1.

As described above, the method for manufacturing the panel element 1 according to an aspect of the present invention is consisted of a process of printing the printed layer 4*a* formed of an ink that does not transmit light on the front side of the resin sheet 3 and a process of superimposing and printing the printed layers 4*b* and 4*c* on an upper surface of the printed layer 4*a* to form the laminated printed layer 4 and a process of removing a part of the laminated printed layer 4 by irradiating with laser light to form a hole portion having a vertical end face in the laminated printed layer 4.

The printed layers 4*a*, 4*b*, and 4*c* of the panel element 1 are printed by screen printing with high detail. Therefore, it is possible to apply a beautiful decoration comparable to conventional gravure printing, such as a woodgrain tone, to the panel element 1. In addition, when a graphic (punched character or punched pattern) is formed by irradiating the laminated printed layer 4 with laser light from a front side thereof, an end face of a hole portion is formed vertically. As a result, it is possible to obtain a panel element without incomplete light shielding area at a peripheral portion of a hole portion formed and having a graphic with a clear contour.

The above description is a part of the embodiment of the present invention, and various other embodiments are contemplated. The laminated printed layer 4 on the front side of the resin sheet 3 and the back surface printed layer 7 on the back side thereof each may include any number of layers.

For example, in order to improve scratch resistance of the printed surface of the panel element 1 after laser marking, a surface of the panel element 1 may be coated with a light-transmissive protective film of a light-curable coating material or a thermosetting coating material. Formation of such a scratch-resistant layer is essential in a case where the panel element 1 is used as a component for a vehicle.

What is claimed is:

1. A method for manufacturing a panel element including a transparent sheet having a front side printed, comprising:

a process of printing a first printed layer formed of an ink that does not transmit light on the front side of the transparent sheet;

a process of superimposing and printing a second printed layer on an upper surface of the first printed layer to form a laminated printed layer;

a process of printing a third printed layer formed of an ink that does not absorb laser light on a back side of the transparent sheet;

an attachment process of attaching the transparent sheet having the laminated printed layer to a resin substrate constituting the panel element; and a process of irradiating the laminated printed layer with laser light on a front side thereof to remove a part of the laminated printed layer and to form a hole portion having a vertical end face in the laminated printed layer, at a position corresponding to the third printed layer of the transparent sheet after the attachment process.

2. The method for manufacturing the panel element according to claim 1, wherein an ink that absorbs the laser light is used for the first printed layer.

3. The method for manufacturing the panel element according to claim 1, wherein the second printed layer includes multiple printed layers.

4. The method for manufacturing the panel element according to claim 1, wherein the third printed layer includes a colored layer colored in a predetermined color and a white layer.

* * * * *